US006528714B1

(12) United States Patent
Liao

(10) Patent No.: US 6,528,714 B1
(45) Date of Patent: Mar. 4, 2003

(54) HI-HAT CYMBAL STAND

(76) Inventor: Tsun-Chi Liao, 1F, No. 7, Lane 545, Sec. 2, Chun-Kung Rd., Chung-King Li, Taichung (TW)

( * ) Notice: Subject to any disclaimer, the term of this patent is extended or adjusted under 35 U.S.C. 154(b) by 4 days.

(21) Appl. No.: 10/022,205

(22) Filed: Dec. 20, 2001

(51) Int. Cl.[7] ..... G10D 13/02
(52) U.S. Cl. ..... 84/442.3; 84/422.1; 84/422.2
(58) Field of Search ..... 84/421, 329, 422.1, 84/422.2, 422.3, 4

(56) References Cited

U.S. PATENT DOCUMENTS 6,096,958 A * 8/2000 Liao ..... 84/422.1
6,188,007 B1 * 2/2001 Liao ..... 84/422.1
6,215,056 B1 * 4/2001 Liao ..... 84/422.1
6,329,584 B1 * 12/2001 Liao ..... 84/422.1

* cited by examiner

*Primary Examiner*—Kim Lockett
(74) *Attorney, Agent, or Firm*—Bacon & Thomas, PLLC

(57) ABSTRACT

A hi-hat cymbal stand mainly having a rod for holding cymbals, a movable foot pedal located at a lower section of the rod, and a contractible tripod. One leg of the tripod may be detached for adding more equipment around the stand without interference. A sliding plate is provided to help anchor with other two legs on the floor. The depressing plate may be loosened to disengage two hooks of a bottom plate from the axis of a post plate so that the foot pedal may be turned and leaned on the rod to facilitate storing and carrying.

2 Claims, 7 Drawing Sheets

HI-HAT CYMBAL STAND

FIELD OF THE INVENTION

This invention relates to a hi-hat cymbal stand and particularly a hi-hat cymbal stand allowable to shrink to a small size rapidly to facilitate carrying.

BACKGROUND OF THE INVENTION

Percussion instruments are essential musical instruments used in concerts. There are many different types of percussion instruments available for generating different audio effect desired. Around the stands for holding the percussion instruments, there are usually also microphone stands or other drum stands. Drummers usually have to play many different types of percussion instruments, and have to step with one foot or two feet the foot pedals located at the bottom of the drum stands or hi-hat cymbal stands to generate required sound while use a spare foot to step the floor to count the beat of the music. In addition, the drummers also have to occasionally strike the cymbals with drumsticks. All this requires the drummer moving their hands and feet swiftly and busily. Hence it is essential to provide the drummers with maximum help and with least possible interference and distractions. However the stands around the drummers for holding percussion instruments and microphones often become sources of interference and impedance. Moreover, the concert tours always have to move to different sites and have to set up rapidly a lot of musical instruments and audio equipment in a limited time period. To make the instruments easy and fast to assemble and disassemble, and smaller sizes to facilitate carrying and transportation become very important.

SUMMARY OF THE INVENTION

It is therefore a primary object of this invention to provide a hi-hat cymbal stand that has a foot pedal with a detachable bottom plate and a bottom pedal which is turnable to lean on a rod. The bottom plate is engageable with a depressing plate through a fastening element and has two hooks to engage with or disengage from a pivotal axis of a post plate. The stand further has a tripod which may be moved closely to the rod and shrunk to a smaller size by moving an anchor ring up or down on the rod. All this allows the stand to shrink to a smaller size to facilitate carrying and transportation.

It is another object of the invention to provide a detachable leg in the tripod around the rod, the sliding plate may replace the detachable leg to couple with two other legs of the tripod to allow the stand standing on the floor steadily and firmly.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
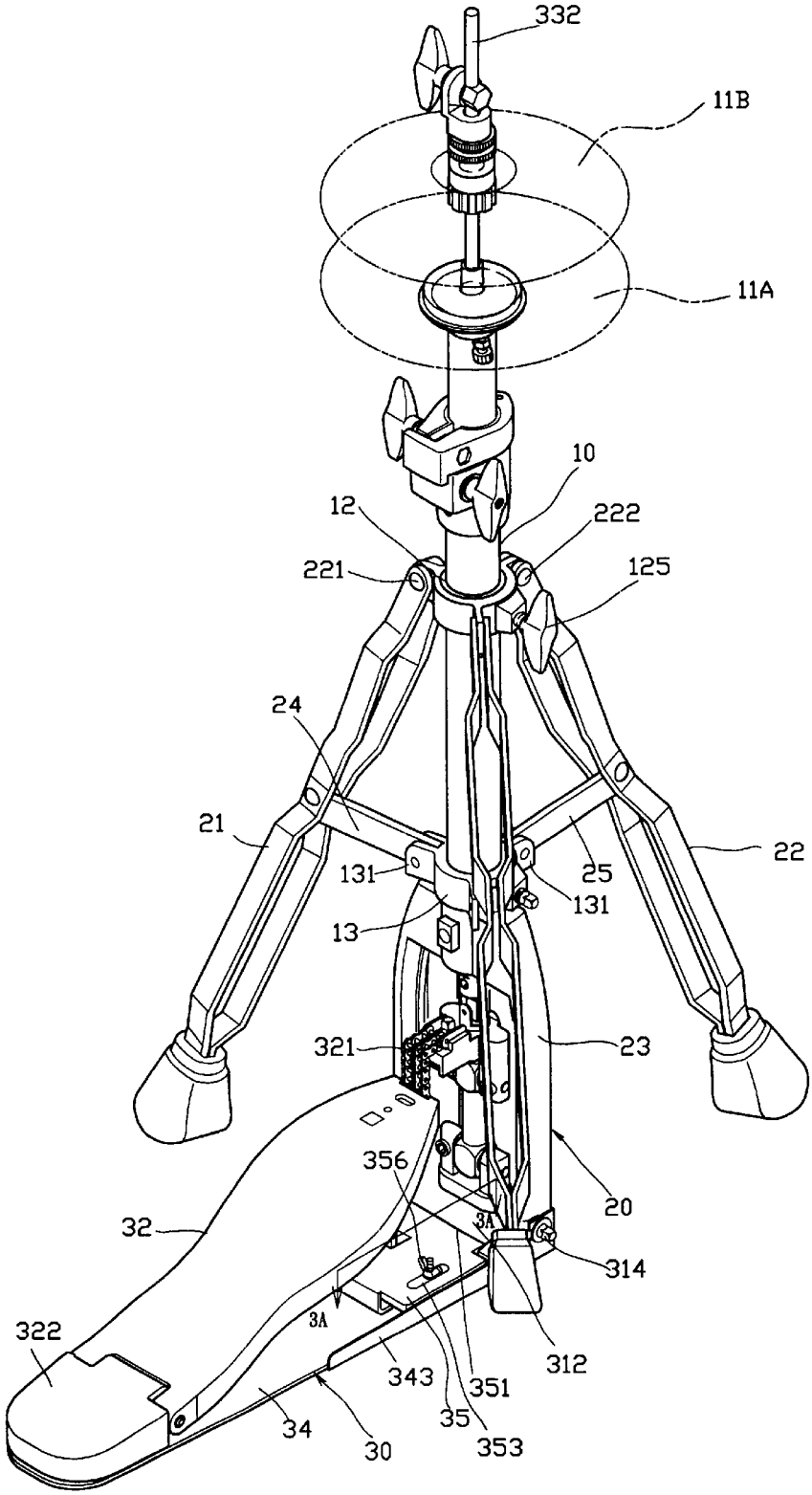
FIG. 1 is a perspective view of a preferred embodiment of the invention.
Figure 2:
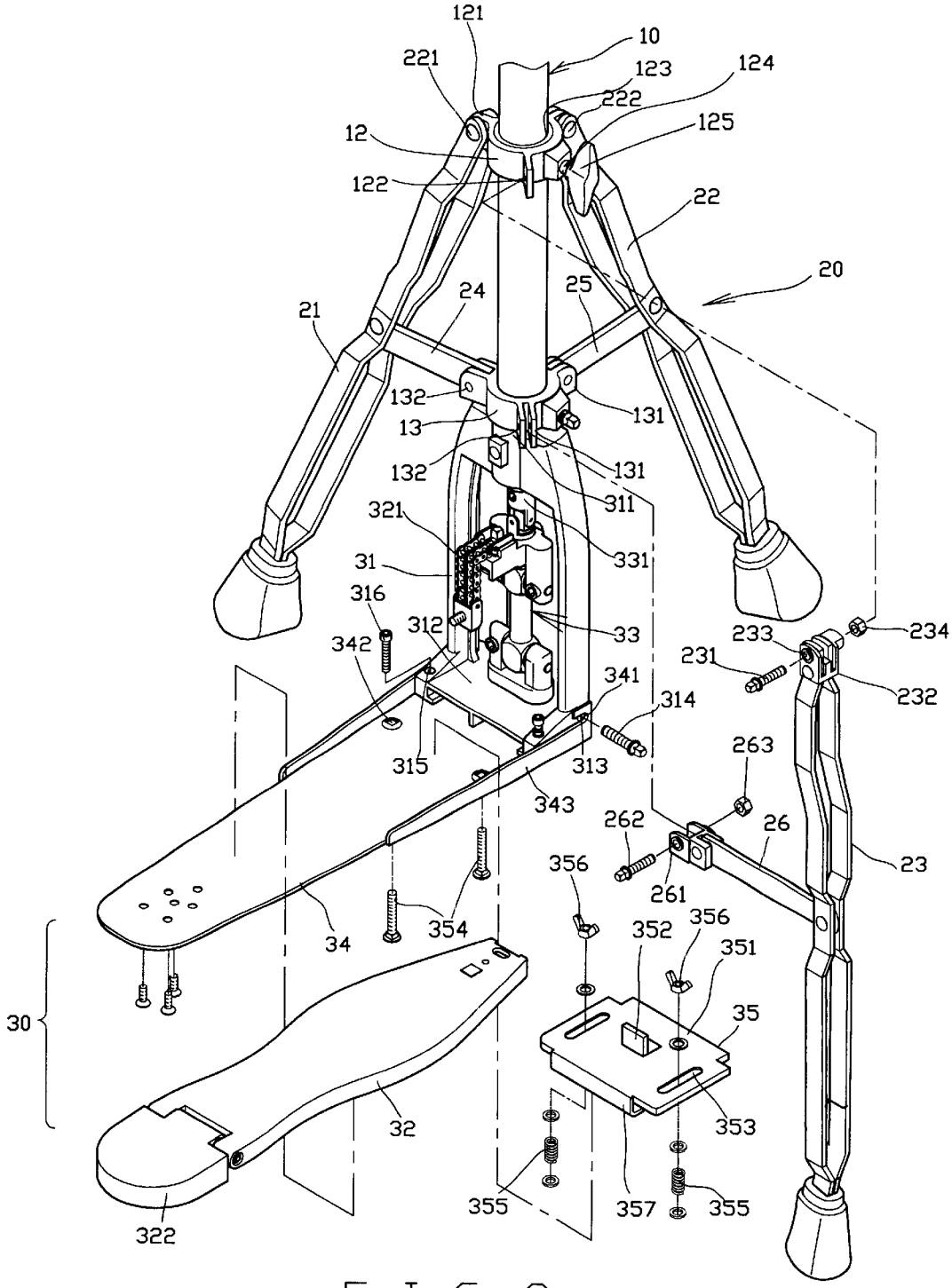
FIG. 2 is an exploded view of this invention according to FIG. 1.
Figure 3A:
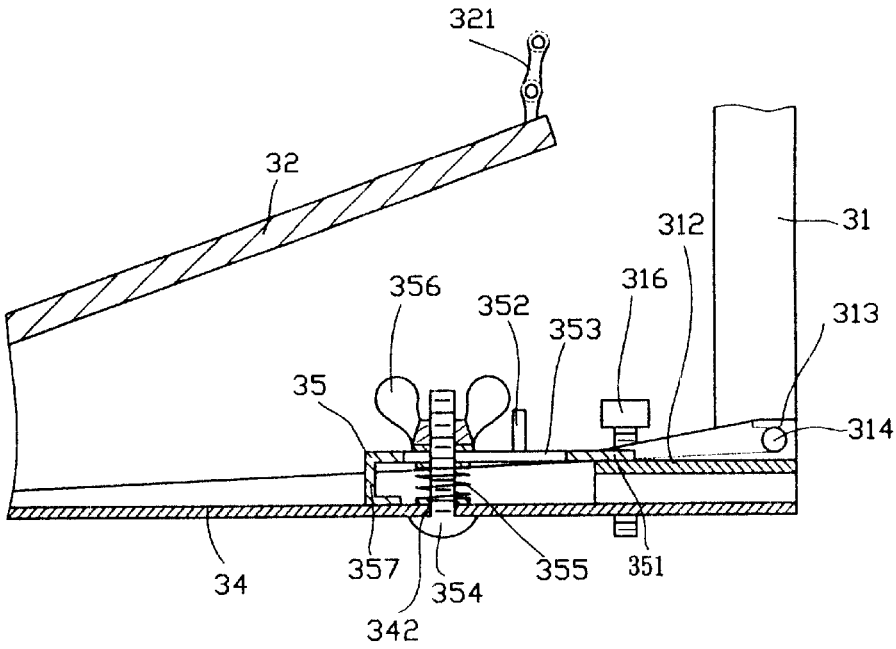
FIG. 3A is a fragmentary cross section taken along line 3A—3A in FIG. 1.
Figure 3B:
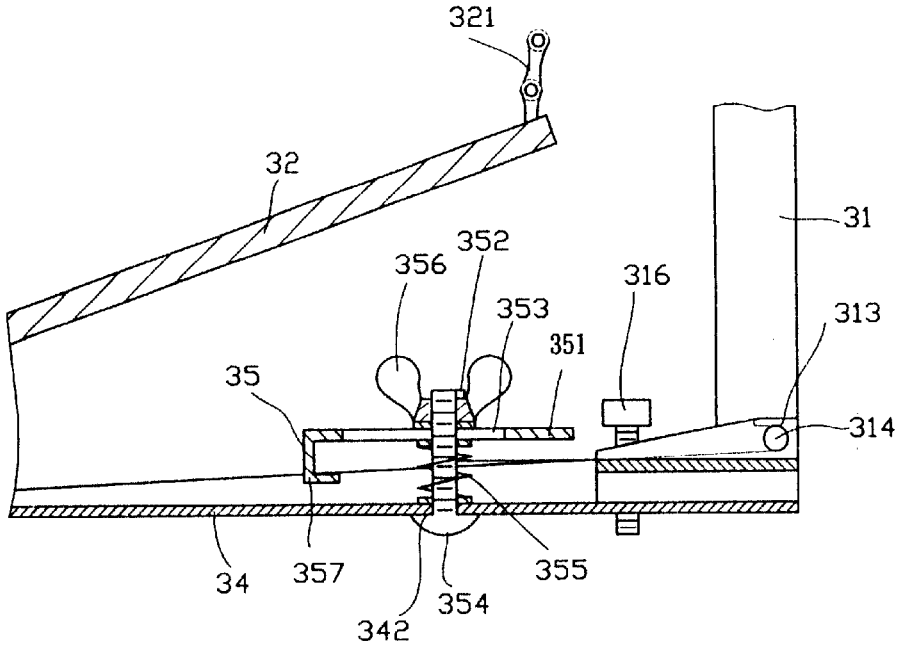
FIG. 3B is a fragmentary cross section of the invention at an operating condition according to FIG. 3A.
Figure 3C:
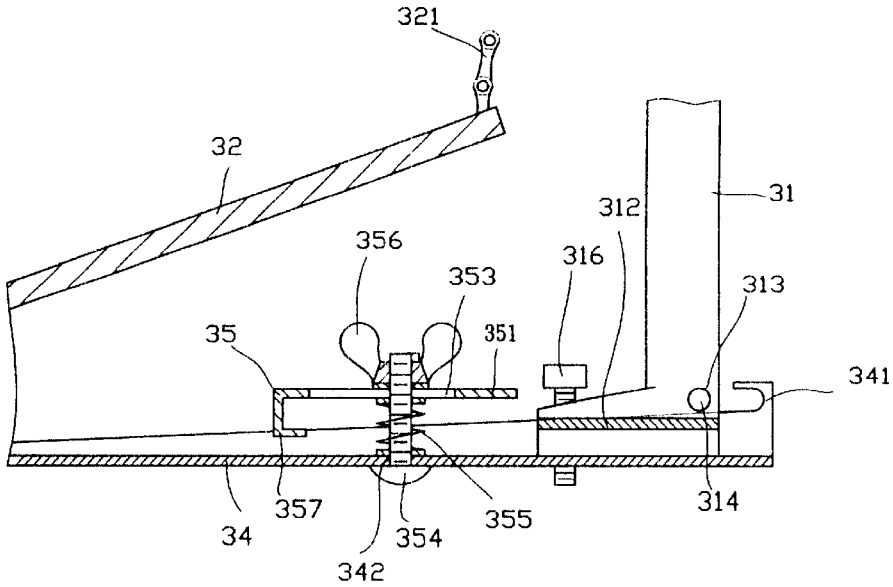
FIG. 3C is a fragmentary cross section of the invention at another detaching operating according to FIG. 3A.
Figure 3D:
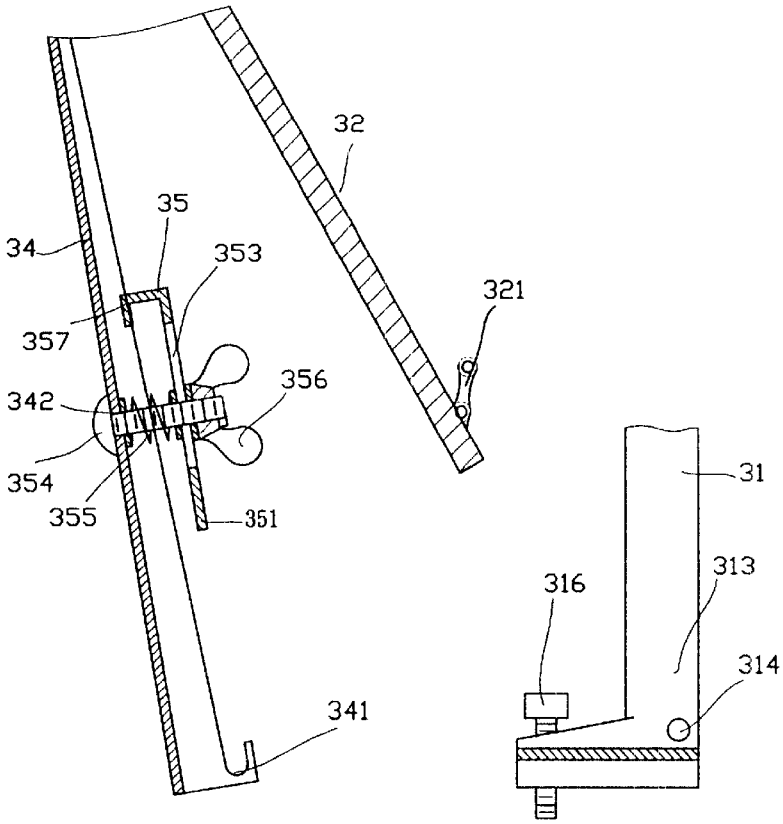
FIG. 3D is a fragmentary cross section of the invention at yet another operating condition according to FIG. 3A.

Referring to FIGS. 1 and 2, the hi-hat cymbal stand of the invention mainly includes a rod 10, a tripod 20 movably coupled with a middle section of the rod 10 and a foot pedal 30 engaging with the bottom end of the rod 10.

The rod 10 has a top end mounting a lower cymbal 11A.

Figure 4:
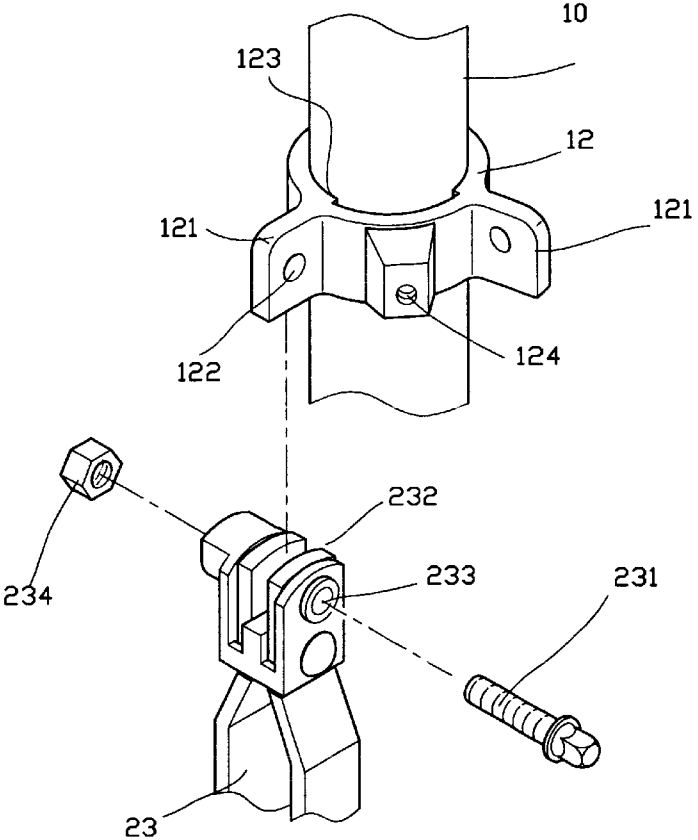
FIG. 4 is a fragmentary perspective view of an embodiment of the invention.
Figure 5:
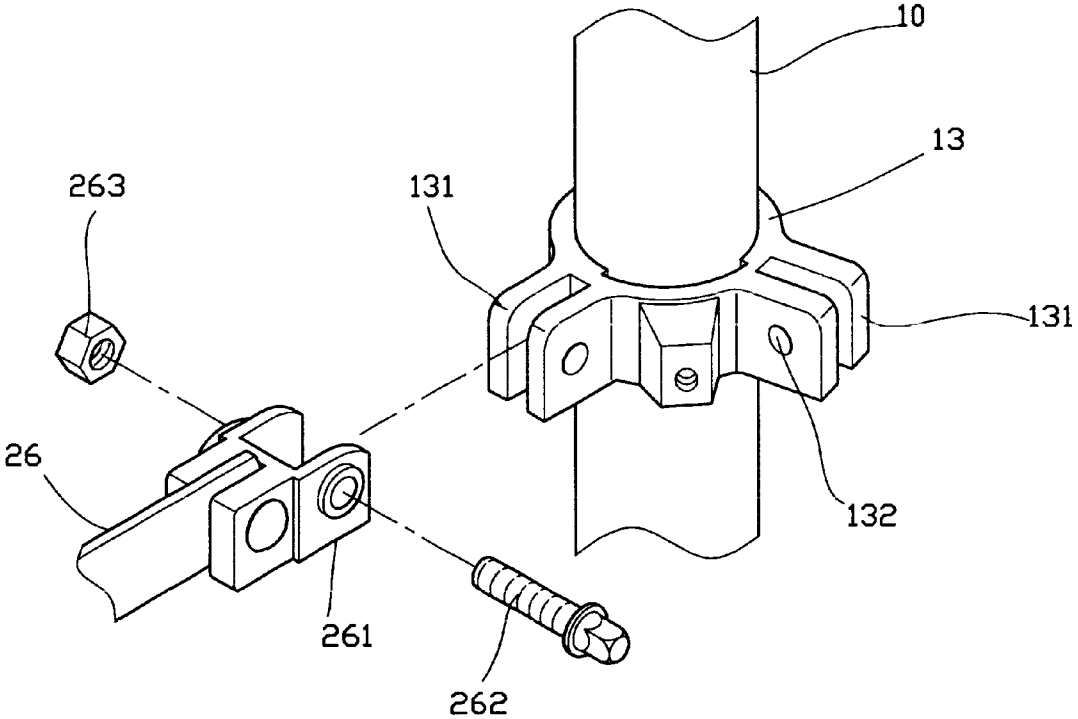
FIG. 5 is another fragmentary perspective view of an embodiment of the invention.

The tripod 20 has two legs 21, 22 which have respectively a top end pivotally engaged through fastening elements such as rivets 221, 222 with a lug 121 extending from the periphery of an anchor ring 12, and another leg 23 which has a top coupling head 232 with an aperture 233 formed thereon. The coupling head 232 is pivotally engaged with another lug 121 on the anchor ring 12 through a screw bolt 231 running through the aperture 233 and another aperture 122 formed on the lug 121. The screw bolt 231 is fastened by a screw nut 234 (referring to FIG. 4). The anchor ring 12 has a center opening 123 to couple with the middle section of the rod 10 and has a screw bore 124 to engage with a set screw bolt 125 for fastening the tripod 20 to the rod 10. The legs 21, 22, 23 have respectively a middle section pivotally engaged with a rocker arm 24, 25, 26. The rocker arms 24, 25 have respectively a bottom end pivotally engaged through fastening elements such as rivets with a pair of chucking lugs 131 located on a periphery of a tube sleeve 13 which is coupled with a lower section of the rod 10. The rocker arm 26 of another leg 23 has a chucking head 261 at the front end to couple with another chucking lug 131 of the tube sleeve 13 from outside, and is fastened by a screw bolt 262 through an aperture formed on the chucking head 261 and an aperture 132 formed on another chucking lug 131 on the tube sleeve 13. The screw bolt 262 is fastened by a screw nut 263 (referring to FIG. 5).

The foot pedal 30 includes an upright post 31 and a tilted pedal plate 32. The post 31 has a top section coupled with a bottom end of a tube 311. The tube 311 has a hollow interior to house a linking bar 33 which has an axle 331 running through the hollow interior of the rod 10 and a top end 332 exposed outside the top end of the rod 10.

The linking bar 33 is connected to a chain 321 located at a rear side of the pedal plate 32 so that the tilted pedal plate 32 may be depressed to move the axle 331 downwards to drive an upper cymbal 11B hitting the lower cymbal 11A to generate sound desired. The pedal plate 32 has another end pivotally engaged with a bottom plate 34. The bottom plate 34 has a front end which has two sides forming respectively a hook 341. The bottom plate 34 further has two apertures 342 formed thereon and two upward wing plates 343 located at two sides thereof. On the bottom plate 34, there is a depressing plate 35 located between the two wing plates 343. The depressing plate 35 has a front flange 351 pressing a horizontal post plate 312 of the post 31. The depressing plate 35 further has a jutting ledge 352 extending upwards from a middle section thereof to allow users to move the depressing plate 35 forwards or rearwards with hands. The depressing plate 35 also has two adjusting slots 353 located on the left and right side thereof. A fastening element such as a screw 354 may be deployed to run through the aperture 342 of the bottom plate 34, an elastic element 355 and a washer, then run through the adjusting slot 353 of the depressing plate 35 and a washer to engage with a wing nut 356 for fastening (referring to FIG. 3). By means of aforesaid construction, the front flange 351 of the depressing plate 35 may depress the horizontal post plate 312 of the post 31. The depressing plate 35 has another end extending downwards to form a foot flange 357 to rest on the top surface of the bottom plate 34. The post 31 further has a fastening aperture 313 located respectively on the left side and right side thereof to engage with a screw bolt 314. The screw bolt 314 may engage with the hook 341 for fastening the bottom plate 34 to the fastening aperture 313, thereby to connect the post 31 with the bottom plate 34. The post plate 312 further has two apertures 315 located on two sides thereof to match screw bores 344 located on two sides of the bottom plate 34 for engaging with a screw bolt 316 to fasten the two. The screw bolt 316 has the bottom end contact the floor to reinforce anchoring effect of the bottom plate 34.

Figure 6:
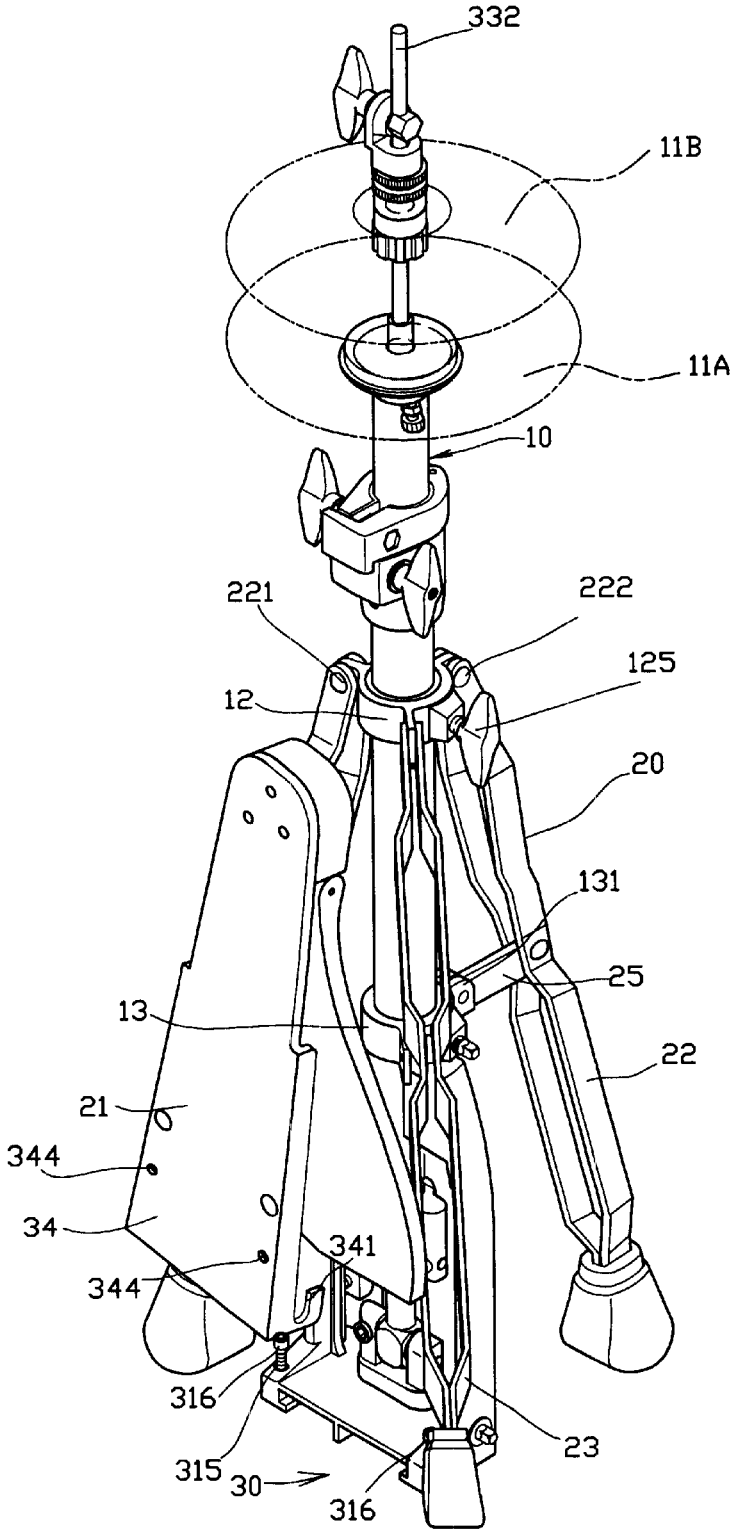
FIG. 6 is a perspective view of an embodiment of this invention at a folding condition.

When drummers are on concert tours at different locations, the carrying musical instruments and supporting stands and brackets should be folded rapidly and packed in small sizes whenever possible. Through the foot pedal 30 structure of the invention set forth above, when there is a need for folding (referring to FIGS. 3A through 3D), the wing nuts 356 may be unfastened first, then move the depressing plate 35 rearwards by means of the ledge 352 with the adjusting slots 353 moving rearwards about the screws 354. The post plate 312 of the post 31 may be separated from the depressing plate 35, and the hook 341 of the bottom plate 34 may be moved to disengage from the screw bolt 314, the bottom plate 34 thus may be moved and lean towards the periphery of the post 31 (as shown in FIG. 6). Moreover, the set screw bolt 125 may be unfastened to allow the anchor ring 12 moving upwards so that the rocker arms 24, 25, 26 may be moved closely towards the rod 10. Then the set screw bolt 125 may be fastened again to anchor the tripod 20 around the rod 10 in a small size to facilitate carrying and transportation.

It is to be noted, the screw bolt 231 of the leg 23 is movably fastened to the anchor ring 12 and may be detached easily. When there is a need to set up another drum stand or other instrument stand beside the hi-hat stand, or drummers want to move the foot across the pedal plate 32 frequently, the three legs of the tripod 20 that space 120 degrees may become an impedance to operations, then the leg 23 may be detached and removed. And the bottom plate 34 of the foot pedal 30 may couple with two other legs 21, 22 to form a steady support for the rod 10 on the floor. And more space may be spared around the rod 10 to accommodate more instrument stands required. The anchor ring 12 and tube sleeve 13 also may be turned simultaneously around the rod 10 to adjust the angles of the legs 21, 22 connected to the anchor ring 12 and tube sleeve 13 relative to the foot pedal 30 until meeting drummers' requirements for smooth operations and firm support.

What is claimed is:

1. A hi-hat cymbal stand, comprising:

a rod having an anchor ring movably located at a middle section thereof and a tube sleeve located at a lower section thereof, the anchor ring having a periphery which has jutting lugs extending outwards;

a tripod pivotally coupled with the jutting lugs through fastening elements having rocker arms pivotally engaged with the tube sleeve; and a foot pedal engaged with a bottom end of the rod including an upright post and a pedal plate, the post housing a linking bar therein to engage with one end of the pedal plate, the linking bar having an axle extending outside the top end of the rod for mounting an upper cymbal, the pedal plate having another end pivotally engaged with a bottom plate in a tilted manner;

wherein said tripod has three legs each has a top end engaging with the anchor ring and a middle section engaging with the rocker arm through screws, the post having a horizontal post plate located at a lower section thereof, the bottom plate having two sides each having a hook to pivotally engage with an axis of the post plate, and a plurality of adjusting apertures for receiving a first fastening element to allow a depressing plate mounted to the bottom plate moving forwards or rearwards, the depressing plate having a front flange harnessed by the post plate of the post, the depressing plate being allowed to anchor the foot pedal for replacing one leg of the tripod and to couple with two other legs of the tripod to hold the stand upright on the floor, the depressing plate being allowed to loosen for disengaging the hooks of the bottom plate from the axis of post plate to allow the foot pedal turning and leaning on the rod to facilitate storing and carrying.

2. The hi-hat cymbal stand of claim 1, wherein the post has a fasten aperture to engage with a second fastening element corresponding to the hook, the depressing plate having another end extending downwards to form a foot flange resting on the bottom plate, the first fastening element being run through an elastic element and an adjusting slot of the depressing plate to engage with a screw nut.

* * * * *